US008938978B2

(12) United States Patent
Bailey et al.

(10) Patent No.: US 8,938,978 B2
(45) Date of Patent: Jan. 27, 2015

(54) GAS TURBINE ENGINE COMBUSTOR WITH LOBED, THREE DIMENSIONAL CONTOURING

(75) Inventors: Donald Mark Bailey, Greenville, SC (US); Jonathan Dwight Berry, Greenville, SC (US); Luis Manuel Flamand, Greenville, SC (US); Kwanwoo Kim, Cincinnati, OH (US); Patrick Benedict Melton, Greenville, SC (US); Robert Joseph Rohrssen, Greenville, SC (US); John Drake Vanselow, Greenville, SC (US)

(73) Assignee: General Electric Company, Schenectady, NY (US)

( * ) Notice: Subject to any disclaimer, the term of this patent is extended or adjusted under 35 U.S.C. 154(b) by 939 days.

(21) Appl. No.: 13/099,938

(22) Filed: May 3, 2011

(65) Prior Publication Data

US 2012/0279224 A1 Nov. 8, 2012

(51) Int. Cl.

| | |
|---|---|
| ***F23R 3/28*** | (2006.01) |
| ***F23R 3/46*** | (2006.01) |
| ***F23R 3/54*** | (2006.01) |

(52) U.S. Cl.

CPC ..... *F23R 3/283* (2013.01); *F23R 3/286* (2013.01); *F23R 3/46* (2013.01); *F23R 3/54* (2013.01); *F23D 2900/00003* (2013.01); *F23R 2900/00017* (2013.01); *F23R 2900/00018* (2013.01)

USPC ..... 60/804; 60/746; 60/747; 60/737; 60/740

(58) Field of Classification Search

CPC ..... F23R 3/283; F23R 3/286; F23R 3/46; F23R 3/54; F23R 2900/00017; F23R 2900/00018; F23R 2900/00003

USPC ..... 60/737, 740, 742, 746, 747, 748, 60/752–760, 804

See application file for complete search history.

(56) References Cited

U.S. PATENT DOCUMENTS

| | | | | |
|---|---|---|---|---|
| 6,122,916 | A * | 9/2000 | Amos et al. | 60/747 |
| 6,735,949 | B1 * | 5/2004 | Haynes et al. | 60/746 |
| 6,951,108 | B2 * | 10/2005 | Burrus et al. | 60/746 |
| 2003/0010014 | A1 * | 1/2003 | Bland et al. | 60/39.37 |
| 2006/0156734 | A1 * | 7/2006 | Bland | 60/776 |
| 2006/0242939 | A1 * | 11/2006 | Pieussergues et al. | 60/39.35 |
| 2007/0151250 | A1 * | 7/2007 | Haynes | 60/772 |
| 2007/0151251 | A1 * | 7/2007 | Haynes | 60/772 |
| 2010/0300106 | A1 * | 12/2010 | Edwards et al. | 60/752 |
| 2011/0062253 | A1 * | 3/2011 | Cihlar | 239/533.11 |

FOREIGN PATENT DOCUMENTS

| | | | |
|---|---|---|---|
| EP | 623735 | A1 | 11/1994 |
| EP | 318312 | A1 | 5/1999 |
| EP | 1739357 | A2 | 1/2007 |

(Continued)

*Primary Examiner* — William H Rodriguez
*Assistant Examiner* — Carlos A Rivera
(74) *Attorney, Agent, or Firm* — Cantor Colburn LLP

(57) ABSTRACT

A gas turbine engine combustor is provided and includes an array of fuel nozzles, a combustion casing assembly disposed about the array of fuel nozzles and an end cap assembly disposed within the combustion casing assembly to define with the combustion casing assembly an axis-symmetric annulus through which fluid travels into each of the fuel nozzles, at least one of the combustion casing assembly and the end cap assembly being formed with lobed, three-dimensional contouring.

14 Claims, 5 Drawing Sheets

(56) References Cited

FOREIGN PATENT DOCUMENTS

| | | | |
|---|---|---|---|
| EP | 1882817 | A2 | 1/2008 |
| EP | 1933007 | A2 | 6/2008 |
| EP | 197056 | A1 | 9/2008 |
| EP | 1988260 | A2 | 11/2008 |
| EP | 2039889 | A2 | 3/2009 |
| EP | 2055895 | A2 | 5/2009 |
| EP | 2169238 | A1 | 3/2010 |
| EP | 2182186 | A2 | 5/2010 |
| WO | 2004064990 | A2 | 8/2004 |

* cited by examiner

GAS TURBINE ENGINE COMBUSTOR WITH LOBED, THREE DIMENSIONAL CONTOURING

BACKGROUND OF THE INVENTION

The subject matter disclosed herein relates to a gas turbine engine combustor.

In a gas turbine engine, compressor discharge feed air is output from a compressor and supplied to a combustor. The combustor includes components, such as the combustion casing and the end cap, that are formed to cooperatively define an axis-symmetric annulus through which the feed air travels.

The annulus first directs the feed air to travel from an aft axial location of the combustor toward the combustor head end where the annulus directs the feed air to flow radially inwardly and then to flow in an axially aft direction whereby the feed air enters fuel nozzles for combustion. Thus, the feed air follows a 180° turn in the annulus as the feed air flows into the fuel nozzles. Often, this turning is associated with the fact that considerable head loss is expended from the feed air as the feed air turns and forms flow field feeding the fuel nozzles

BRIEF DESCRIPTION OF THE INVENTION

According to one aspect of the invention, a gas turbine engine combustor is provided and includes an array of fuel nozzles, a combustion casing assembly disposed about the array of fuel nozzles and an end cap assembly disposed within the combustion casing assembly to define with the combustion casing assembly an axis-symmetric annulus through which fluid travels into each of the fuel nozzles, at least one of the combustion casing assembly and the end cap assembly being formed with lobed, three-dimensional contouring.

According to another aspect of the invention, a gas turbine engine combustor is provided and includes a central fuel nozzle, a plurality of outer fuel nozzles arrayed substantially uniformly about the central fuel nozzle, a combustion casing assembly disposed about the array of outer fuel nozzles and an end cap assembly disposed within the combustion casing assembly to define with the combustion casing assembly an axis-symmetric annulus through which fluid travels into each of the fuel nozzles, at least one of the combustion casing assembly and the end cap assembly being formed with lobed, three-dimensional contouring relating to at least each of the plurality of outer fuel nozzles.

According to yet another aspect of the invention, a gas turbine engine combustor with a single component lobed insert is provided and includes an array of fuel nozzles, an end cover, a combustion casing assembly connected to the end cover and disposed about the array of fuel nozzles, an end cap assembly disposed within the combustion casing assembly to define an axis-symmetric annulus through which fluid travels into each of the fuel nozzles, and an insert connected to an aft face of the end cover within the combustion casing assembly, the insert including a medallion shaped body having an aft face formed with lobed, three-dimensional contouring comprising scallop sections relating to each of the fuel nozzles.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
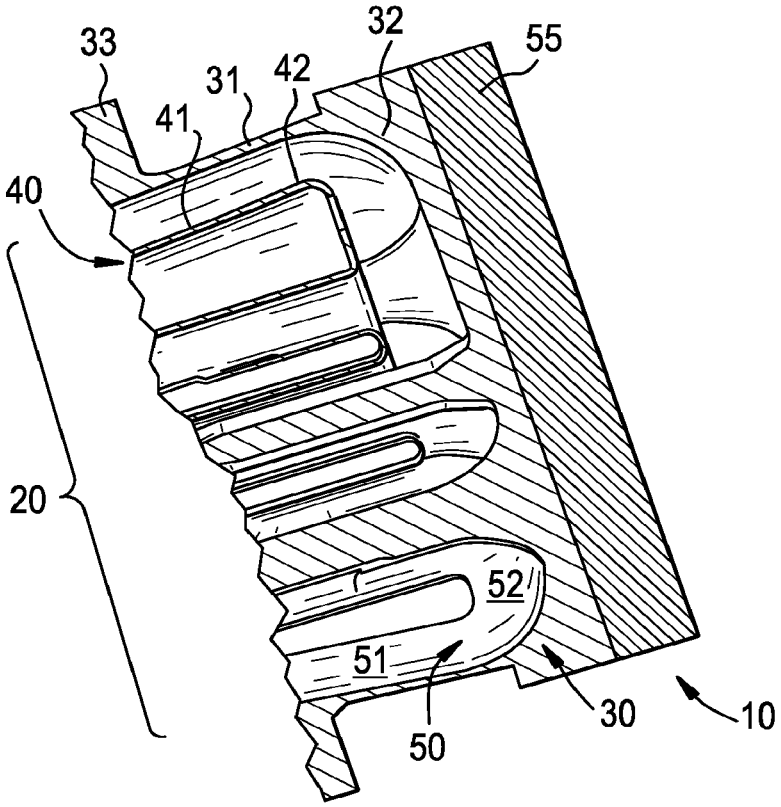
FIG. 1 is a side view of a gas turbine engine combustor.
Figure 2:
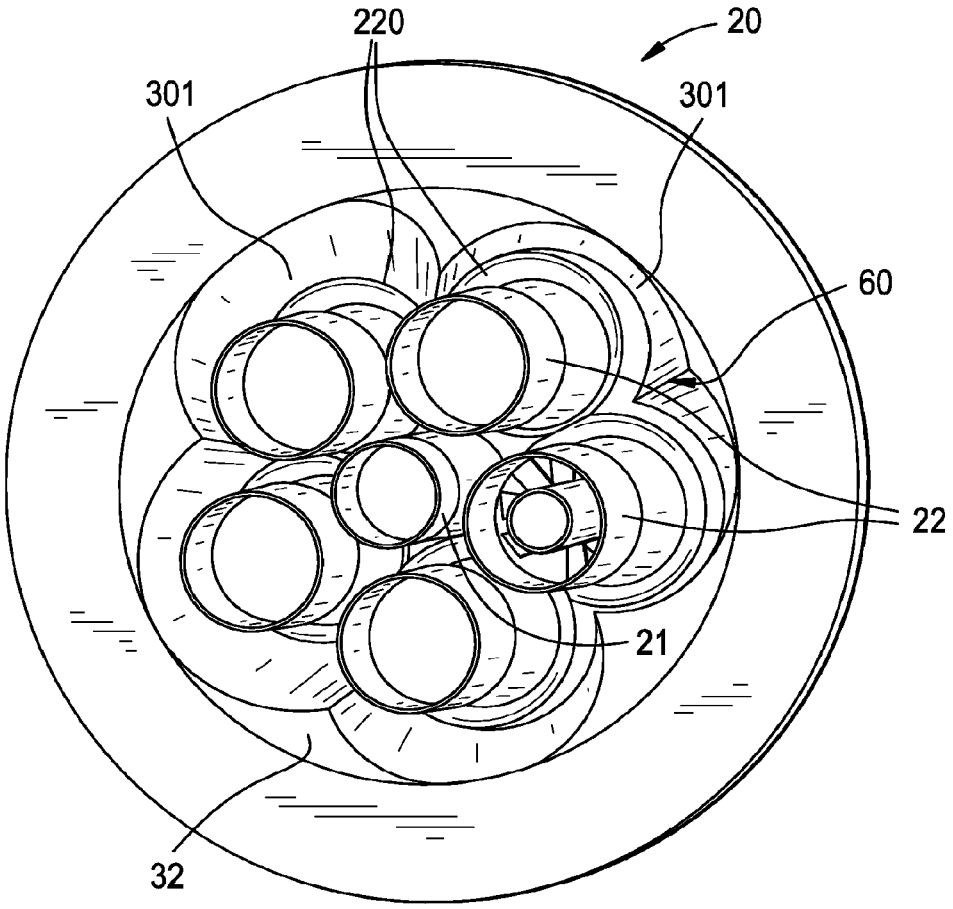
FIG. 2 is a perspective view of components of the combustor of FIG. 1.
Figure 3:
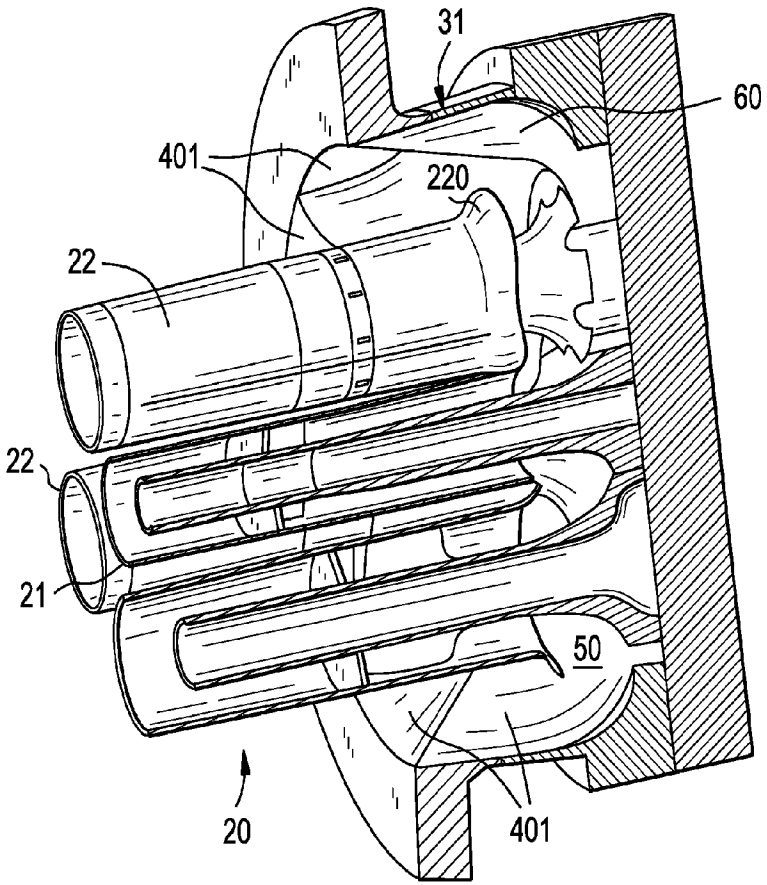
FIG. 3 is a perspective view of components of the combustor of FIG. 1.

With reference to FIGS. 1-3, a gas turbine engine combustor 10 is provided. The combustor 10 includes an array of fuel nozzles 20, including a central fuel nozzle 21 and individual outer fuel nozzles 22, a combustion casing assembly 30 disposed about the array of fuel nozzles 20 and an end cap assembly 40. The end cap assembly 40 is disposed within the combustion casing assembly 30 to define an axis-symmetric annulus 50 through which fluid, such as compressor discharge feed air, travels into each of the central fuel nozzle 21 and the individual outer fuel nozzles 22.

The array of the fuel nozzles 20 may be configured with the central fuel nozzles 21 formed at a central radial position and the individual outer fuel nozzles 22 arrayed around the central fuel nozzle 21. The individual outer fuel nozzles 22 may be arrayed substantially uniformly around the central fuel nozzle 21. In accordance with embodiments, five individual outer fuel nozzles 22 may be provided. Each of the outer fuel nozzles 22 includes an annular flange 220 extending outwardly.

The combustion casing assembly 30 may include a casing barrel 31 that extends axially and has an annular shape in which the array of fuel nozzles 20 is disposed, a forward flange 32 at a forward end of the casing barrel 31 and an aft flange 33 at an aft end of the casing barrel 31. The forward flange 32 may be affixed to the end cover 55. The end cap assembly 40 includes an end cap baffle 41 and a turning plate 42. The end cap baffle 41 extends axially and may have an annular shape for disposition within the casing barrel 31. The turning plate 42 connects with the end cap baffle 41 and with the flanges 220 of the outer fuel nozzles 22 to form a smooth transition at a head end of the combustor 10.

The end cap baffle 41 and the casing barrel 31 form a first portion 51 of the axis-symmetric annulus 50. The turning plate 42 and the flanges 220 of each of the individual outer fuel nozzles 22 form a second portion 52 of the axis-symmetric annulus 50 with the forward flange 32. The first portion 51 leads into the second portion 52 such that fluid flows smoothly through both in sequence. In particular, the fluid flows in a first direction (i.e., toward the head end) through the first portion 51. The fluid then flows radially inwardly and then in a second direction, which is opposite the first direction (i.e., away from the head end), through the second portion 52.

With reference to FIGS. 2 and 3, at least one of the combustion casing assembly 30 and the end cap assembly 40 is formed with lobed, three-dimensional contouring 60. As such, a flow field of fluid making the 180° turn is guided to enter the central fuel nozzle 21 and the individual outer fuel nozzles 22 and is thus improved with corresponding reductions in head losses and increases in gas turbine cycle efficiency.

Figure 4:
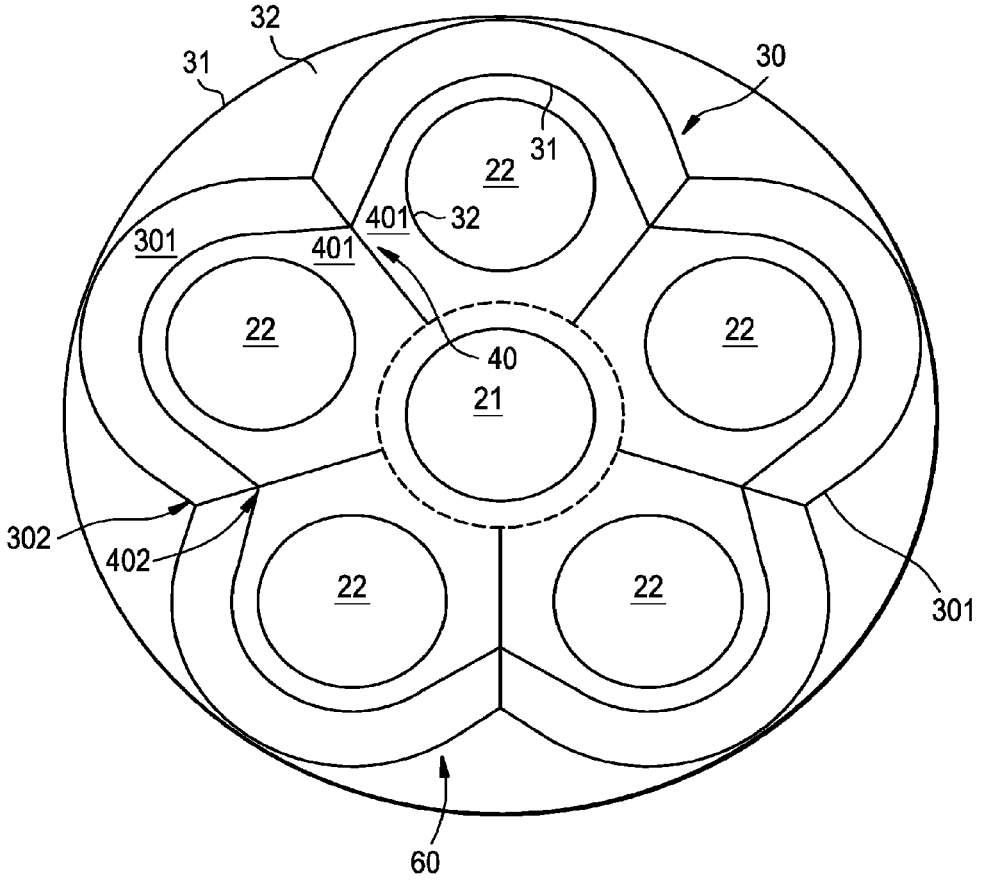
FIG. 4 is an axial view of lobed, three-dimensional contouring in accordance with embodiments.

With reference to FIG. 4, the lobed, three-dimensional contouring 60 of the combustion casing assembly 30 may include a scallop structure 301 formed at least on the casing barrel 31 and/or the forward flange 32 and the lobed, three dimensional contouring 60 of the end cap assembly 40 may also include a scallop structure 401 formed at least on the end cap baffle 41, the turning plate 42 and/or the flanges 220. In each case, the lobed, three-dimensional contouring 60 may relate to at least one or more of the central fuel nozzle 21 and the individual outer fuel nozzles 22 or, in accordance with further embodiments, the lobed, three-dimensional contouring 60 may relate to each of the individual outer fuel nozzles 22.

In the latter cases, the scallop structure 301 is plural in number, with the plurality of scallop structures 301 provided in a circumferential array on the casing barrel 31 about the array of fuel nozzles 20 and on the forward flange 32. Each of the plurality of scallop structures 301 is thus associated with a corresponding individual outer fuel nozzle 22. Similarly, the scallop structure 401 is plural in number, with the plurality of scallop structures 401 provided in a circumferential array about the array of fuel nozzles 20 on at least on the end cap baffle 41, the turning plate 42 and/or the flanges 220. Each of the plurality of scallop structures 401 is thus associated with a corresponding individual outer fuel nozzle 22. The plurality of scallop structures 301 and the plurality of scallop structures 401 may be circumferentially and radially aligned with respect to each of the corresponding individual outer fuel nozzles 22.

With this construction, adjacent ones of the scallop structures 301 cooperatively define a groove portion 302, which extends axially along the casing barrel 31 and radially along the forward flange 32, and which is positioned circumferentially between adjacent ones of the individual outer fuel nozzles 22 with which the adjacent scallop structures 301 are respectively associated. By contrast, adjacent ones of the scallop structures 401 cooperatively define a rim portion 402, which extends along at least the end cap baffle, the turning plate 42 and/or the flanges 220, and which is positioned circumferentially between adjacent ones of the individual outer fuel nozzles 22 with which the adjacent scallop structures 401 are respectively associated. The rim portion 402 may extend radially inwardly between adjacent individual outer fuel nozzles 22 to a periphery of the central fuel nozzle 21. The groove portions 302 and the rim portions 402 thereby cooperatively urge fluid traveling through the second portion 52 of the axis-symmetric annulus 50 to flow toward and into the central fuel nozzle 21 and each of the individual outer fuel nozzles 22 by providing the fluid with curved pathways and by dividing the fluid into portions thereof for each fuel nozzle.

Figure 5:
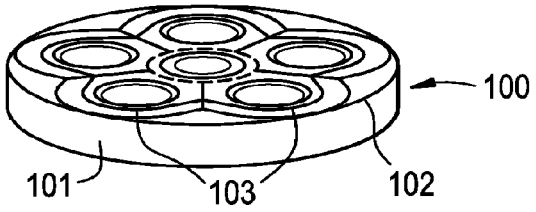
FIG. 5 is a perspective view of a single component lobed insert.
Figure 6:
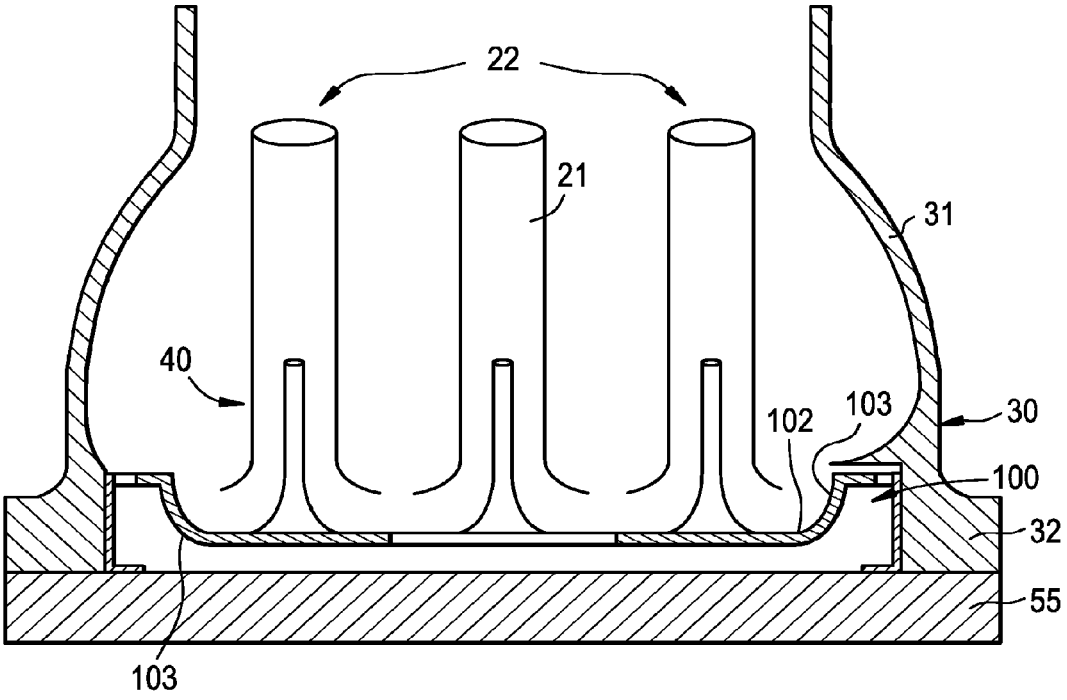
FIG. 6 is a side view of a combustor with the single component lobed insert of FIG. 5 installed therein.

In accordance with another aspect of the invention and, with reference to FIGS. 5 and 6, a single component lobed insert (hereinafter referred to as the "insert") 100 is provided. The insert 100 can be installed in the combustor 10 as a replacement or substitute for a radially interior portion of the above-mentioned forward flange 32 and is connectable with an aft face of the end cover 55 within the casing barrel 31 that is also connectable with the end cover 55. As shown in FIG. 5, the insert 100 includes a medallion shaped body 101 with an aft face 102 that is formed with lobed, three-dimensional contouring and includes scallop sections 103 at least for association with each of the outer fuel nozzles 22. The insert 100 can thus relatively inexpensively mitigate a need to machine or cast complex geometry into the forward flange 32, the casing barrel 31 or the flanges 220, for example. A combination of the insert 100 and some cast-in-lobe features in base components could also be employed.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A gas turbine engine combustor, comprising:

an array of fuel nozzles including a central fuel nozzle and outer fuel nozzles spaced about the central fuel nozzle;

a combustion casing assembly disposed about the array of fuel nozzles; and an end cap assembly disposed within the combustion casing assembly to define with the combustion casing assembly an axis-symmetric annulus through which fluid travels into each of the fuel nozzles, the combustion casing assembly and the end cap assembly being formed with lobed, three-dimensional contouring relating to each of the outer fuel nozzles and extending radially inwardly between adjacent outer fuel nozzles to a perimeter of the central fuel nozzle.

2. The gas turbine engine combustor according to claim 1, wherein the fluid comprises compressor discharge feed air.

3. The gas turbine engine combustor according to claim 1, wherein the axis-symmetric annulus directs the fluid to flow in a first direction, radially inwardly and then in a second direction opposite the first direction.

4. The gas turbine engine combustor according to claim 1, wherein the combustion casing assembly comprises:

a casing barrel that extends axially and has an annular shape in which the array of fuel nozzles is disposed;

a forward flange at a forward end of the casing barrel; and an aft flange at an aft end of the casing barrel, wherein the lobed, three-dimensional contouring of the combustion casing assembly comprises a scallop structure provided at least on the casing barrel and/or the forward flange.

5. The gas turbine engine combustor according to claim 4, wherein adjacent scallop structures define a groove portion.

6. The gas turbine engine combustor according to claim 4, wherein the end cap assembly comprises:

an end cap baffle; and a turning plate at a forward end of the end cap baffle, wherein the lobed, three dimensional contouring of the end cap assembly comprises a scallop structure provided at least one the end cap baffle and/or the turning plate.

7. The gas turbine engine combustor according to claim 6, wherein adjacent scallop structures form a rim portion.

8. The gas turbine engine combustor according to claim 1, wherein the array of fuel nozzles comprises:

the central fuel nozzle; and five outer fuel nozzles substantially uniformly spaced about the central fuel nozzle.

9. The gas turbine engine combustor according to claim 1, wherein each of the fuel nozzles comprises a flange formed with lobed, three-dimensional contouring.

10. The gas turbine engine combustor according to claim 9, wherein the flange of each of the fuel nozzles connects with the end cap assembly.

11. The gas turbine engine combustor according to claim 1, wherein the lobed, three-dimensional contouring of the combustion casing assembly and the end cap assembly are circumferentially aligned.

12. The gas turbine engine combustor according to claim 1, wherein the lobed, three-dimensional contouring of the combustion casing assembly and the end cap assembly are radially aligned.

13. A gas turbine engine combustor, comprising:

a central fuel nozzle;

a plurality of outer fuel nozzles arrayed substantially uniformly about the central fuel nozzle;

a combustion casing assembly disposed about the array of outer fuel nozzles; and an end cap assembly disposed within the combustion casing assembly to define with the combustion casing assembly an axis-symmetric annulus through which fluid travels into each of the fuel nozzles, the combustion casing assembly and the end cap assembly being formed with lobed, three-dimensional contouring relating to each of the plurality of outer fuel nozzles.

14. A gas turbine engine combustor with a single component lobed insert, the gas turbine engine combustor comprising:

a central fuel nozzle;

an array of fuel nozzles arrayed substantially uniformly about the central fuel nozzle;

an end cover;

a combustion casing assembly connected to the end cover and disposed about the array of fuel nozzles;

an end cap assembly disposed within the combustion casing assembly to define an axis-symmetric annulus through which fluid travels into each of the fuel nozzles; and an insert connected to an aft face of the end cover within the combustion casing assembly, the insert including a medallion shaped body having an aft face formed with lobed, three-dimensional contouring comprising scallop sections relating to each of the fuel nozzles and extending radially inwardly between adjacent outer fuel nozzles to a perimeter of the central fuel nozzle.

* * * * *